US008117882B2

(12) United States Patent
Berg

(10) Patent No.: US 8,117,882 B2
(45) Date of Patent: Feb. 21, 2012

(54) MULTI-LAYER PIPE AND METHOD FOR ITS MANUFACTURE

(75) Inventor: Bernd Berg, Siegen (DE)

(73) Assignee: Bergrohr GmbH Siegen, Siegen (DE)

( * ) Notice: Subject to any disclaimer, the term of this patent is extended or adjusted under 35 U.S.C. 154(b) by 320 days.

(21) Appl. No.: 11/721,467

(22) PCT Filed: Dec. 16, 2005

(86) PCT No.: PCT/EP2005/013569

§ 371 (c)(1),
(2), (4) Date: Jul. 13, 2007

(87) PCT Pub. No.: WO2006/066814

PCT Pub. Date: Jun. 29, 2006

(65) Prior Publication Data

US 2009/0288467 A1 Nov. 26, 2009

(30) Foreign Application Priority Data

Dec. 21, 2004 (DE) ..... 10 2004 062 697

(51) Int. Cl.
*B21D 3/00* (2006.01)
*B21D 9/00* (2006.01)
*B21D 31/00* (2006.01)

(52) U.S. Cl. ..... 72/367.1; 72/369; 72/363

(58) Field of Classification Search ..... 72/48, 51, 72/367.1, 368, 369, 363, 166
See application file for complete search history.

(56) References Cited

U.S. PATENT DOCUMENTS

| | | | | |
|---|---|---|---|---|
| 1,712,090 A | | 5/1929 | Murphy | |
| 2,489,802 A | | 11/1949 | Needham | |
| 2,754,784 A | * | 7/1956 | Maysmor et al. | 228/148 |
| 3,220,602 A | | 11/1965 | Ficker | |
| 3,327,383 A | | 6/1967 | Reed | |

(Continued)

FOREIGN PATENT DOCUMENTS

AT 254791 6/1967

(Continued)

OTHER PUBLICATIONS

International Search Report for PCT/EP2005/013569 dated Mar. 27, 2006.

(Continued)

*Primary Examiner* — Dana Ross
*Assistant Examiner* — Mohammad I Yusuf
(74) *Attorney, Agent, or Firm* — McCormick, Paulding & Huber LLP

(57) ABSTRACT

A method for manufacture of a multi-layer pipe (5) by means of a bending roller with individual material layers (1, 2) to be combined into the multi-layer pipe (5) being placed one upon the other, and the multi-layer material thus formed being shaped into a multi-layer pipe (5) by means of the bending roller, and in the final stage of pipe shaping in the bending roller and/or a subsequently used bending machine a material layer (1) acting as an internal pipe being pressed non-positively into a material layer (2) acting as an external pipe.

14 Claims, 5 Drawing Sheets

U.S. PATENT DOCUMENTS

| | | | | |
|---|---|---|---|---|
| 3,610,290 | A | | 10/1971 | Anderson et al. |
| 4,122,696 | A | | 10/1978 | Midzutani et al. |
| 4,353,764 | A | | 10/1982 | Sireix |
| 4,621,181 | A | * | 11/1986 | Lachmitz ..... 219/62 |
| 4,709,845 | A | | 12/1987 | Akiyama et al. |
| 4,795,078 | A | | 1/1989 | Kuroki et al. |
| 4,980,961 | A | | 1/1991 | Caudill |
| 4,999,903 | A | | 3/1991 | Bujes |
| 5,011,064 | A | | 4/1991 | Fuss |
| 5,097,585 | A | * | 3/1992 | Klemm ..... 29/523 |
| 5,361,618 | A | | 11/1994 | Stefanelli |
| 5,447,179 | A | | 9/1995 | Gibbs et al. |
| 6,238,806 | B1 | | 5/2001 | Sakuraba et al. |
| 2005/0271896 | A1 | | 12/2005 | Stahn et al. |
| 2007/0132228 | A1 | | 6/2007 | Montague |

FOREIGN PATENT DOCUMENTS

| | | | |
|---|---|---|---|
| CA | 261429 | A | 6/1926 |
| CA | 2409351 | | 11/2001 |
| CN | 2493327 | Y | 5/2002 |
| CN | 1375362 | A | 10/2002 |
| DE | 520305 | | 3/1931 |
| DE | 582 387 | | 8/1933 |
| DE | 864689 | | 7/1949 |
| DE | 1951141 | | 5/1970 |
| DE | 3423706 | | 6/1984 |
| DE | 3314264 | C2 | 10/1984 |
| DE | 3927989 | A1 | 3/1991 |
| DE | 10019384 | A1 | 10/2001 |
| DE | 20016937 | U1 | 2/2002 |
| DE | 19826290 | B4 | 9/2005 |
| DE | 10019384 | B4 | 11/2005 |
| DE | 6992214 | T2 | 12/2005 |
| DE | 102004028020 | A1 | 12/2005 |
| DE | 102005028444 | A1 | 12/2006 |
| DE | 102005028444 | B4 | 12/2006 |
| DE | 102007045855 | A1 | 4/2009 |
| DE | 102008024009 | A1 | 12/2009 |
| DE | 102008024011 | A1 | 12/2009 |
| DK | 1107845 | T3 | 11/2004 |
| EP | 0695598 | A1 | 7/1996 |
| EP | 0832701 | A1 | 4/1998 |
| EP | 0950441 | A2 | 10/1999 |
| EP | 0832701 | B1 | 7/2001 |
| ES | 2232163 | T3 | 5/2005 |
| GB | 2057313 | A | 4/1981 |
| JP | 51-013361 | A | 2/1976 |
| JP | 5388651 | | 4/1978 |
| JP | 57050211 | A | 3/1982 |
| JP | 5815448 | A | 9/1983 |
| JP | 60111791 | | 6/1985 |
| JP | 61042427 | A | 2/1986 |
| JP | 61042428 | A | 2/1986 |
| JP | 06-190439 | A | 7/1994 |
| JP | 07214144 | | 8/1995 |
| WO | 2005008116 | A2 | 1/2005 |
| WO | 2008135406 | A1 | 11/2008 |
| WO | 2009034155 | A1 | 3/2009 |
| WO | 2009043530 | A2 | 4/2009 |
| WO | 2009059582 | A2 | 5/2009 |
| WO | 2011076402 | A1 | 6/2011 |

OTHER PUBLICATIONS

Canadian Office Action in corresponding application dated Nov. 2, 2011.

"Mechanical Properties of Carbon and Alloy Steels". ASM Metals Hanbook Desk Edition, 2nd. Edition, pp. 219-225, 1998.

* cited by examiner

MULTI-LAYER PIPE AND METHOD FOR ITS MANUFACTURE

CROSS REFERENCE TO RELATED APPLICATIONS

This application claims the benefit of PCT International Application No. PCT/EP2005/013569, filed Dec. 16, 2005 and German Application No. 10 2004 062 697.9, filed Dec. 21, 2004, the disclosures of which are herein incorporated by reference in their entirety.

BACKGROUND OF THE INVENTION

The present invention relates to a multi-layer pipe as well as a method for its manufacture. Multi-layer pipes are preferably used when high demands exist against corrosion or abrasion.

Corrosion-resistant pressure vessels or pressure lines can be produced in a more cost-effective way than solid versions of corresponding materials when multi-layer pipes are used. This is achieved by load distribution on a thin, corrosion-resistant internal layer (e.g. stainless and acid-resistant steel) and a high-strength and pressure-proof external layer (e.g. fine-grained structural steel). Steel consumption can be considerably decreased as a result and a large part of the remaining steel consumption can be shifted to more cost-effective materials.

In certain grades, abrasion-resistant pipelines can only be manufactured when being executed as a multi-layer pipe (for instance with mechanical bonding, see below), since materials (e.g. high-strength steels with high hardness) can be used as an internal layer which for itself cannot be processed into pipes or only under great difficulties.

Other material combinations are possible in a great diversity but basically the combination possibilities of materials are restricted in this context only by the processing methods eligible in each case.

When creating the pipe sheathing, there are two possibilities

- metallurgical bonding over the entire surface (requiring cladded plates as initial semi-finished product), and
- merely mechanical bonding (for instance friction bonding) between internal and external pipe—preferably internal and external plates and their welding on the plate edges—.

Manufacture of such multi-layer pipes is done as follows in Prior Art:

For multi-layer pipes with metallurgical bonding between the layers—for instance multi-layer pipes out of metal plates, preferably steel plates—a cladded composite plate made out of two different (steel) materials is used as an initial semi-finished product. The multi-layer pipe is then manufactured as follows:

- At first the composite plate is produced by roll-bonding or explosion cladding,
- then pipe forming is made in accordance with usual methods such as for example by means of a bending roller or a bending press and
- subsequently welding occurs with the outer wall of the multi-layer pipe being executed in accordance with the usual pipe welding methods pursuant to the material used and inner wall welding occurring as deposition welding likewise pursuant to the material.

The disadvantage of this procedure according to Prior Art is on the one hand the high cost of the initial semi-finished product and thus also of the final product, but on the other hand also insufficient availability of the initial semi-finished product, because production capacities are very restricted for it on a world-wide basis. Thus, as far as is known to the applicant and the inventor, only a few installations exist for the production of roll-bonded multi-layer plates, for instance in Austria and in Japan, but for example, not a single one in the Federal Republic of Germany. Neither installations for explosion cladding do hardly exist as far as is known to the inventor and the applicant. For example, at Dynamit Nobel at Burbach, Federal Republic of Germany, one of a few of such plants exists. The production engineering used for it is also a great problem and therefore expensive and intricate taking into consideration in addition that it is only available for very small production lots, anyhow.

Moreover, the number of materials, which can be processed in this way, is restricted. Thus, for example, certain abrasion-resistant steels cannot be used as an internal layer, if they can hardly be welded or not welded at all due to their high carbon content.

In the case of multi-layer pipes with mechanical bonding, several—preferably two—finished pipes are used as an initial semi-finished product. The process will be explained below by way of an example with two pipes (in the event of more layers, the explanations have to be understood accordingly):

- two finished pipes are manufactured in close fit and moved into each other without friction with the external pipe requiring a higher yield point than the internal pipe
- by expansion (mechanically—for example, by means of an expansion die—or by fluid pressure with the pipes placed into each other being pressed into a die comprising the external pipe) the internal pipe is pressed into the external pipe by elastic expansion of the external pipe. After the expansion forces are omitted, the external pipe places itself non-positively around the internal pipe due to the higher elastic resiliency
- finally the two materials are welded on their faces.

The disadvantage of this process of Prior Art is that the external pipe must have a higher yield point than the internal pipe, since otherwise the elastic resiliency of the external pipe causing the non-positive connection with the internal pipe and therefore being necessary, is missing. This is particularly disadvantageous, because high-strength materials—for instance, especially high-strength steels—as they are especially advantageous preferably for abrasion-resistant pipelines inside the pipe, have high or even very high yield points, and are therefore unsuitable for this manufacturing process.

SUMMARY OF THE INVENTION

It is therefore the object of the present invention to provide on the basis of the State of the Art a multi-layer pipe as well as a method for its manufacture, which on the one hand tries and avoids the above mentioned disadvantages and thus not requiring roll-bonded and/or explosion cladded semi-finished products but which on the other hand is neither subject to the restrictions involved in manufacture of multi-layer pipes according to the State of the Art with frictionally engaged mechanical bonding of layers among each other.

This object is met according to the invention at first by a method for manufacture of a multi-layer pipe in which

- individual material layers (1, 2) to be combined into the multi-layer pipe (5) are placed one upon the other, subsequently a first connection (3, 3*a* and 3*b*, 3*a*$_1$ and 3*a*$_2$, 3*b*$_1$ and 3*b*$_2$, 3*n*$_1$ and 3*n*$_2$) between the material layers (1, 2) is created by connecting them to each other, preferably approximately alongside a longitudinal edge (4) or transverse edge (4*a*) of the material layer positioned above (1), or preferably approximately alongside a line parallel to the edge, the thus formed multi-layer material is shaped into a pipe (5) by means of the bending roller with a constant friction-tight connection being created between the material layers (1, 2) as a result of the pressure of the rollers from the top and from the bottom, and during shaping, the portions (1*c*, 1*d*, 2*a*, 2*b*) of the material layers (1, 2), which can still shift freely against other, shifting freely to each other in accordance with the shaping progress due to the different bending radii of the one layer (1) acting as an internal pipe and the other layer (2) acting as an external pipe, after a predetermined shaping progress at least one other connection (6*a*, 6*b*) is created between the material layers (1, 2) by connecting to each other the material layer (1) positioned on top in at least one other position, preferably approximately alongside a second longitudinal edge (4) or transverse edge (4*a*) of the material layer above (1, 1*a*, 1*b*, 1*n*), or preferably approximately alongside a line parallel to the edge, and the multi-layer pipe (5) is then finish-shaped by means of the bending roller and/or bending machine, with the material layers (1, 2) shifting no more against each other now during this finish-shaping, so that as a result, the material layer (1) acting as an internal pipe is pressed non-positively into the material layer (2) acting as an external pipe.

or, alternatively by a method for manufacture of a multi-layer pipe characterized in that individual material layers (1, 2) to be combined into a multi-layer pipe (5) are place one upon the other with a material layer (2) acting as an external pipe constituting a base plate having approximately alongside its two longitudinal edges or approximately parallel to the edges a, preferably welded, stop edges (10*a*, 10*b*), and the material layer above (1) is positioned loosely between these stop edges (10*a*, 10*b*), and the thus constituted multi-layer material is shaped into a multi-layer pipe (5) by means of the bending roller with the material layer (1) acting as an internal pipe being clamped between the stop edges (10*a*, 10*b*) and the material layer (1) acting as an internal pipe in the final stage of the pipe shaping in the bending roller and/or bending machine subsequently used being pressed as a result non-positively into the material layer (2) acting as an external pipe.

and also by a multi-layer pipe which can be manufactured by the present method according to the invention.

Here, application of roll-bonded and/or explosion cladded semi-finished products can be avoided by pressing the respective material layer acting as an internal pipe already during pipe forming in the bending roller and the bending machine, usually necessary for final shaping, non-positively into the material layer acting as an external pipe so that it is frictionally maintained in the respective external pipe without the necessity to expand the multi-layer pipe and thus running into the disadvantages already mentioned. It is pointed out that in some cases, however, final forming or shaping is already possible in the bending roller alone, for example, in the event of shorter bending rollers which can include the function of end forming of the pipe. In that case a bending machine is not included in the method according to the invention.

If in this text a connection alongside an edge or alongside a (preferably only imaginary) line is mentioned, any type of connection alongside the edge or line is meant, whether this connection exists alongside the entire edge or line or only in sections alongside the edge or line or only in individual spots (such as for example spot welding), for example in two spots—preferably at the end spots of the edge or line—or even only in an individual spot on the edge or on the line.

In another preferred embodiment of the method for manufacture of a multi-layer pipe by means of a bending roller according to the present invention, the first connection between the material layers is created by connecting them alongside one of the longitudinal or transverse edges of the material layer resting on the other material layer, and at least one other connection occurs between the material layers after a definite shaping progress alongside the second longitudinal or transverse edge of the material layer resting on the other material layer.

The at least one other connection between the material layers can, for example, be created after a shaping progress between 50% and less than 100%.

In another, especially preferred embodiment of the method for manufacture of a double-layer pipe as a multi-layer pipe with an external pipe and an internal pipe by means of a bending roller according to the present invention, the shaping progress occurs after the at least one other connection between the material layers is made—called $F_{for}$ here and indicated in parts percent—preferably approximately as follows:

$$F_{for} = \left(1 - \frac{\frac{\sigma_I}{E} \cdot (DA - 2 \cdot SA - SI) \cdot \pi \cdot (Z_s + 1)}{(DA - SA) \cdot \pi - (DA - 2 \cdot SA - SI) \cdot \pi}\right) \cdot 100$$

with

DA being the external diameter of the external pipe in mm,

SA being the wall thickness of the external pipe in mm,

SI being the wall thickness of the internal pipe in mm, $\sigma_I$ being the yield point of the internal pipe in N/mm$^2$ $Z_s$ being the upsetting allowance indicated in parts percent and E being the Young's modulus in N/mm$^2$.

The above mentioned expression results from the following relations:

The length of the neutral fibre of the external pipe—here called $L_{nfa}$—is:

$$L_{nfa} = (DA - SA) \cdot \pi$$

The length of the neutral fibre of the internal pipe—here called $L_{nfi}$—is:

$$L_{nfi} = (DA - 2 \cdot SA - SI) \cdot \pi$$

Shifting of the free plate edge at 100% degree of shaping of the pipe—here called $L_{fv}$—is then:

$$L_{fv} = L_{nfa} - L_{nfi}$$

The degree of upsetting of the internal pipe in order to reach the upsetting limit—here called $\epsilon_{St}$—results as follows:

$$\varepsilon_{St} = \frac{\sigma_I}{E}$$

and the length of upsetting in order to reach the upsetting limit results as:

$$L_{st}=\epsilon_{St}\cdot L_{nfi}\cdot(Z_s+1)$$

The shaping progress during which further connection between the material layers takes place—here called $F_{for}$—is then (indicated as a value between 0 and 1) approximately:

$$F_{for} = 1 - \frac{L_{st}}{L_{fv}}$$

and indicated in parts percent:

$$F_{for} = \left(1 - \frac{L_{st}}{L_{fv}}\right)\cdot 100.$$

If this expression is resolved with:

DA being the external diameter of the external pipe in mm,

SA being the wall thickness of the external pipe in mm,

SI being the wall thickness of the internal pipe in mm, $\sigma_I$ being the yield point of the internal pipe in N/mm$^2$ $Z_s$ being the upsetting allowance indicated in parts percent and E being the Young's modulus in N/mm$^2$ one gets the expression for the shaping progress already specified at the beginning where the further connection takes place between the materials—here called $F_{for}$—and indicated in parts percent. The upsetting allowance takes into account production inaccuracy in locating the at least one other material layer connection and compensates it in such a way that the intended force of pressure of the internal pipe against the external pipe is at least achieved.

Some examples are intended to illustrate this with the minimum and maximum as well as the typical example referring to the percentage degree of shaping at which the at least one other connection between the material layers occurs:

TABLE 1

Examples for Determination of the Shaping Progress for one other Connection of the Material Layers

| Given are: | unit | eventual minimum ex. 1 | typical example ex. 2 | eventual maximum ex. 3 |
|---|---|---|---|---|
| DA (external diameter of external pipe) | mm | 406 | 762 | 2500 |
| SA (wall thickness of the external pipe) | mm | 25 | 20 | 12 |
| SI (wall thickness of the internal pipe) | mm | 10 | 3 | 1 |
| □$_I$ (yield point of internal pipe) | N/mm$^2$ | 100 | 350 | 480 |
| $Z_s$(upsetting allowance) | (%) | 0% | 50% | 15% |
| E (Young's modulus) | N/mm$^2$ | 210,000 | 210,000 | 210,000 |

The searched quantities are then as follows:

TABLE 2

Searched Quantities for the Examples for Determination of the Shaping Progress for another Connection of the Material Layers from Table 1

| For the examples given in table 1, the following results for the searched quantities: | | unit | eventual minimum ex. 1 | typical example ex. 2 | eventual maximum ex. 3 |
|---|---|---|---|---|---|
| length of the neutral fibre of the external pipe: | $L_{nfa}$ = (DA − SA) * □ | mm | 1,196.9 | 2,331.1 | 7,816.3 |
| length of the neutral fibre of the internal pipe: | $L_{nfi}$ = (DA − 2 * SA − SI) * □ | mm | 1,087.0 | 2,258.8 | 7,775.4 |
| shifting of the free plate edge at 100% shaping: | $L_{fv} = L_{nfa} - L_{nfi}$ | mm | 110.0 | 72.3 | 40.8 |
| degree of upsetting of the internal pipe in order to achieve the upsetting limit: | □$_{St}$ = □$_I$/(E | (%) | 0.05% | 0.17% | 0.23% |
| length of upsetting in order to achieve the upsetting limit: | $L_{st} = \square_{St} \cdot L_{nfi} \cdot Z_s$ | mm | 0.52 | 5.65 | 20.44 |
| required degree of shaping for the at least one other connection, for example for locating the second plate edge: | $F_{for} = 1 - L_{st}/L_{fv}$ | (%) | 99.5% | 92.2% | 50.0% |

Another preferred embodiment of the method for manufacture of a multi-layer pipe by means of a bending roller according to the present invention is characterised in that at least one of the material layers comprises more than one element positioned above, preferably more than one plate. The elements positioned above can be positioned with their longitudinal edge in parallel to the material layer below but this must not be the case. Thus it is also possible that they are positioned transversely to it with their longitudinal edge.

If the elements are with their longitudinal edge in parallel—preferably approximately parallel—to the longitudinal edge of the material layer below, the first connection between the material layers is preferably created by the elements, preferably plates, after their positioning on top alongside their joining location, which at the same time constitutes each a longitudinal edge of the elements, preferably plates, of the material layer on top, being connected with the material layers below, preferably the plate below.

This method is particularly suitable for the manufacture of multi-layer pipes according to the present invention having large diameters, preferably greater than 610 mm (24"), where often the width of available internal layer material strips, preferably steel strips (steel plates), is not sufficient, in order to produce an entire internal layer for such large pipes. If even two strips are not sufficient, the procedure can be continued at will: in that case three or even more elements, preferably plates, are positioned.

In the method for manufacture of a multi-layer pipe by means of a bending roller according to the present invention, the multi-layer pipe is preferably closed by welding of the external pipe alongside the pipe seam and a deposition welding of the internal pipe in order to produce the multi-layer pipe body.

Also, the material layers 1 and 2 can be connected together after closing at the pipe end faces, for example to prevent humidity from penetrating between the material layers which are metallurgically not connected over their entire mating surfaces.

A preferred application of the method according to the present invention is the manufacture of inventive double-layer pipes, although the invention is not restricted to it. Also three-, four-layer pipes and pipes with even more layers can generally be produced according to the present invention which is far more difficult in Prior Art or even not possible at all.

In another especially preferred embodiment of the present invention, plates, preferably metal plates, and more preferably, steel plates, are used as material layers or elements of the material layer.

Also, in the method for manufacture of a multi-layer pipe by means of a bending roller according to the present invention, preferably at least one of the connections of the material layers is made as a welding, which is particularly suitable for the metal plates, preferably steel plates, mentioned above.

Another preferred embodiment of the method for manufacture of a multi-layer pipe by means of a bending roller according to the present invention is characterised in that individual material layers to be combined into a multi-layer pipe are put onto each other with a material layer, which acts as an external pipe, constituting a base plate, which has approximately alongside its two longitudinal edges or approximately parallel to it, a, preferably welded, stop edge, and the material layer above being positioned loosely between these stop edges, and the thus constituted multi-layer material is shaped into a multi-layer pipe by means of the bending roller with the material layer, which acts as an internal pipe, being clamped between the stop edges and the material layer, which acts as an internal pipe, in the final stage of the pipe shaping in the bending roller and/or bending machine subsequently used being pressed as a result non-positively into the material layer acting as an external pipe.

According to this embodiment of the present invention thus also such materials—as for example very high-strength steels—can be used as a respective internal layer which cannot be welded or can be welded only under great difficulties. But the principle of the invention remains the same also in this embodiment. The material layer acting as an internal pipe already during pipe shaping in the bending roller is non-positively pressed into the material layer acting as an external pipe and thus frictionally maintained in the respective external pipe.

A gap is preferably left between the edges of the material layer positioned on top and the stop edges which will close only during the pipe shaping process.

After forming of the pipe body, the material layer acting as an internal pipe due to the impact of force can be shifted within the material layer acting as an external pipe so that a plug-in sleeve is formed permitting pipes to be plugged into each other so that pipe assembly on site is extremely simplified.

For completion of the pipe body also in this embodiment of the procedure according to the present invention welding of the external pipe is preferably done alongside the pipe seam.

The inventive multi-layer pipe, in particular the multi-layer pipe obtained according to the inventive method, can be formed in particular such that a material layer positioned inside has a higher yield point or proof stress (see below) compared with the outer material layer with at least one material layer comprising preferably a metal plate, and more preferably, a steel plate.

An especially preferred embodiment of a multi-layer pipe according to the present invention is characterised in that the multi-layer pipe is formed as a double-layer pipe exhibiting two steel plate material layers with the steel plate, which acts as an internal pipe, having a high up to a very high carbon content and thus is at least not necessarily weldable any more.

The multi-layer pipes obtained in such a way according to the present invention are different from those of Prior Art in a variety of ways but without these differences having to become evident all at the same time in one multi-layer pipe according to the present invention which could be identified accordingly. Rather these difference can also occur in different combinations among each other but need not do so necessarily.

Thus according to the present invention it is on the one hand not necessary to use cladded plates (with the disadvantages, already discussed at the beginning, of long delivery times and limited availability as well as high prices), on the other hand nevertheless multi-layer pipes—especially double-layer pipes out of steel plate material layers—with a high yield point of the material of the respective internal pipe and simultaneous low yield point of the material of the respective external pipe can be manufactured, which is necessary, for example, for such applications of multi-layer pipes requiring a possibly high abrasion resistance of the internal pipe, since high abrasion resistance normally coincides also with a high hardness which in turn coincides with a high yield point. Such multi-layer pipes having an internal pipe made out of a material with a higher or the same yield point than the respective external pipe but which have nevertheless no metallurgical connection of adjacent layers over the entire surface, cannot be manufactured according to Prior Art. They do not exist until now. But they become possible due to the present invention. It must be pointed out that in the event of a not very distinct yield point—for example, in cases of only increased plastic deformation—the proof stress will be substituted for the yield point as the amount of stress of a plastic permanent expansion under a certain impact of force.

Independent of what has been said above, the method according to the present invention permits in addition a far greater plurality of material combinations for the inventive multi-layer pipes. For example, in Prior Art certain abrasion-resistant steels cannot be used as an internal layer, since these not only due to the high yield point usually coinciding with their high abrasion resistance are not suitable to be used alone (e.g. as a single layer pipe) for the pipe shaping process, and also would have to be welded for internal pipe formation, but are hardly or not at all suitable for it due to their high carbon content, i.e. cannot necessarily be welded (see above). Therefore, corresponding pipes do likewise not exist until today. But the method according to the present invention, which in a preferred embodiment takes advantage of the non-positive pressing of the respective internal pipe into the respective external pipe during the manufacturing process, permits manufacture also of such multi-layer pipes, which use as an internal layer a non-weldable or not necessarily weldable material—for example a steel with a high, and preferably very high carbon content—. Thus also the use of materials not weldable at all such as for example modern plastics having the desired properties of an internal pipe layer, becomes possible at all. Pipes with such internal layers do likewise not exist until today.

Again independent of it, also multi-layer pipes can be manufactured by means of the method according to the present invention, without using expensive and hardly available, cladded plates (mechanically connected over the entire surface), in almost any large diameters, which is not possible according to Prior Art, since here the necessary expansion is limited by the dimensions of the expansion die used, or by a die necessary for uniform shaping in the case of a hydraulic expansion force impact which encloses the multi-layer pipe to be manufactured. Compared with this the inventive roll bending process permits multi-layer pipes, which are not subject to such predetermined limitations, since the bending roller, which intervenes for shaping purposes always only in one location of the pipe radius of curvature, does not limit the diameter of the inventive multi-layer pipe. Thus in particular also multi-layer pipes without cladded plates can be manufactured which exceed—and preferably exceed by far—the limit of the present State of the Art of a diameter of approx. 610 mm (24").

The present invention permits manufacture of multi-layer pipes with partial internal layer at all, i.e. an internal pipe forming a graduated circle in cross-section, for example in the form of a channel insert at the pipe base which is likewise not possible in Prior Art until now.

In this connection it should be mentioned that according to method of the present invention of course also pipes in only very small quantities, especially also individual pipes, can be economically manufactured, which in Prior Art on the one hand is impeded by the intricate cladding and the minimum production lots necessary for it, and on the other hand by the especially set up tools and appliances required for expansion.

BRIEF DESCRIPTION OF THE DRAWINGS

Below, non-limitative embodiments will be discussed by means of the drawings, in which.

DESCRIPTION OF THE PREFERRED EMBODIMENTS

Figure 1:
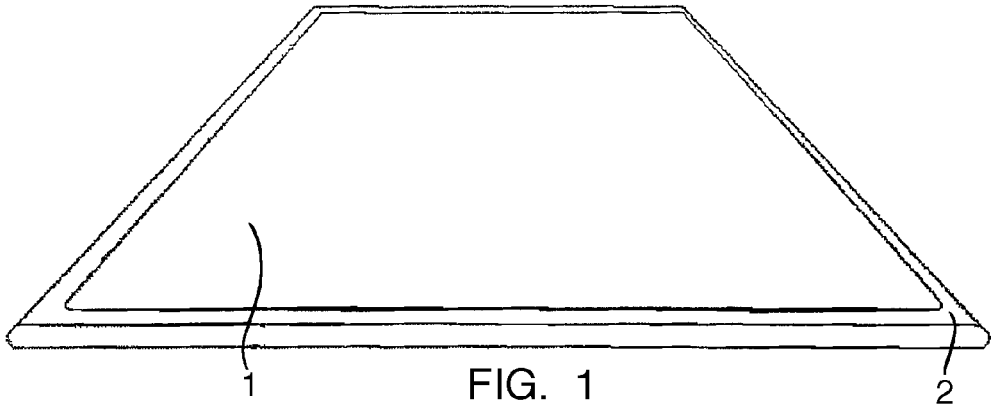
FIG. 1 is a perspective plan view of two material layers, to be combined into a multi-layer pipe, put onto each other.

FIG. 1 shows a perspective plan view of two material layers 1, 2, to be combined into a multi-layer pipe, put onto each other.

Figure 2:
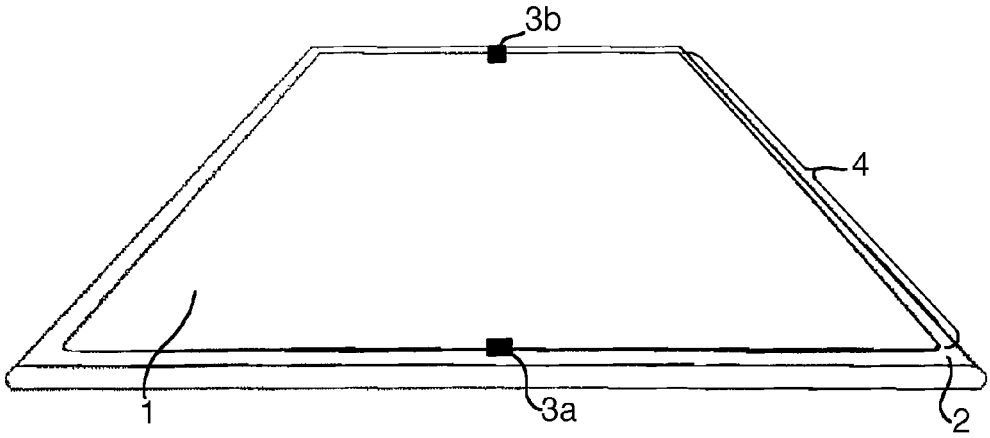
FIG. 2 is a perspective plan view of two material layers, to be combined into a multi-layer pipe, put onto each other, with a first connection, preferably welding, between the material layers, approximately alongside an (imaginary) line parallel to one of the longitudinal edges of the material layer positioned above.

FIG. 2 shows a perspective plan view of two material layers, to be combined into a multi-layer pipe, put onto each other, with a first connection 3*a* and 3*b*—preferably welding (namely in the points 3*a* and 3*b*)—between the material layers 1, 2, approximately alongside an (imaginary) line parallel to a longitudinal edge 4 of the material layer positioned above 1.

Figure 3:
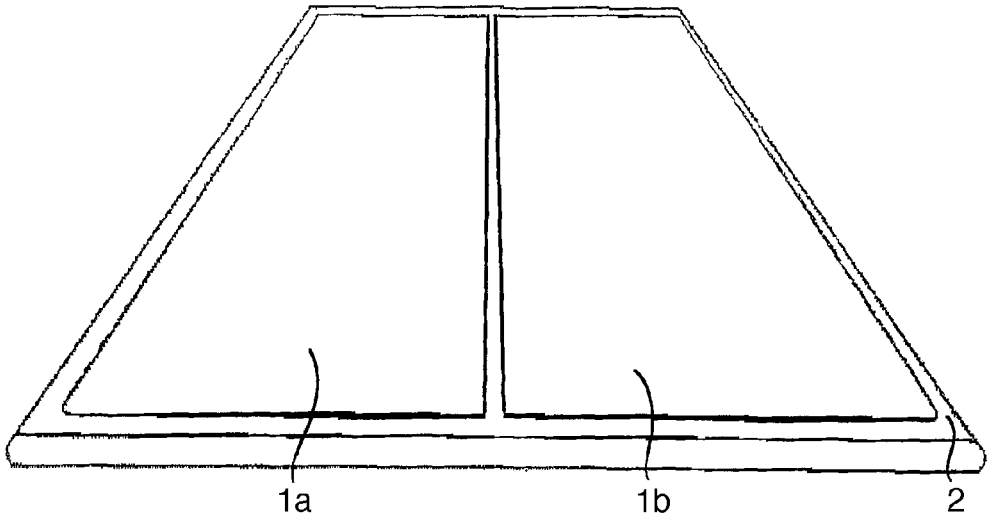
FIG. 3 is a perspective plan view of two material layers, to be combined into a multi-layer pipe, put onto each other, with one of the material layers comprising two elements—preferably plates—placed in longitudinal pipe direction.

FIG. 3 is a perspective plan view of two material layers 1*a*, 1*b*, 2, to be combined into a multi-layer pipe, put onto each other, with one of the material layers here, namely the material layer placed above, comprising two elements 1*a*, 1*b*—preferably plates—placed in longitudinal pipe direction.

Figure 3A:
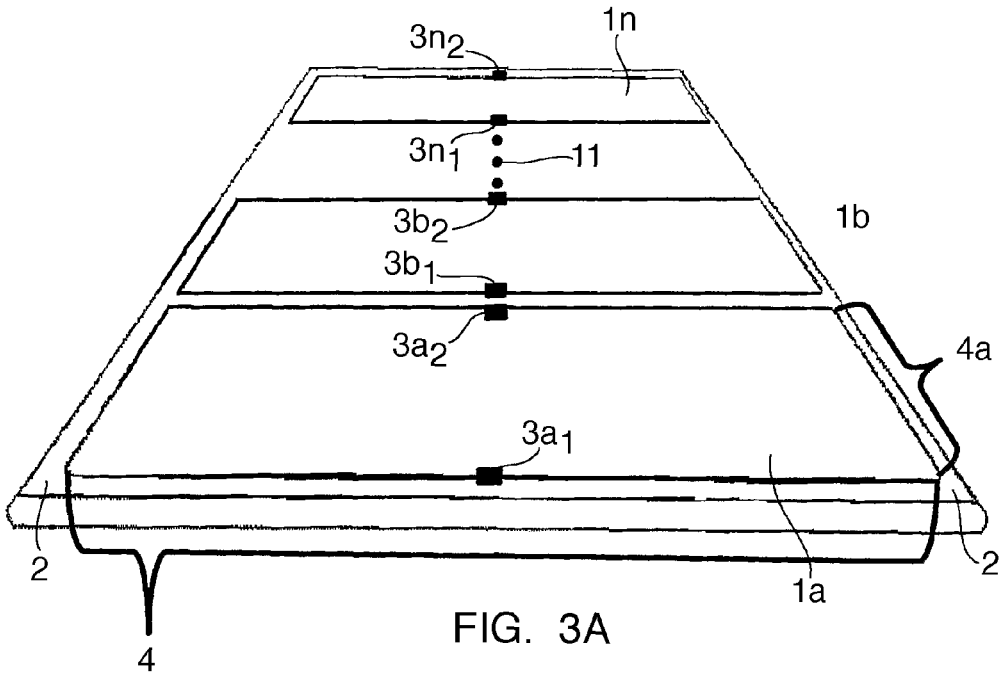
FIG. 3*a* is another perspective plan view of two material layers, to be combined into a multi-layer pipe, put onto each other, with one of the material layers, namely the material layer placed above, constituting a plurality of elements—preferably plates—placed in circumferential pipe direction.

FIG. 3*a* is another perspective plan view of two material layers 1*a*, 1*b*, . . . , 1*n*, 2, to be combined into a multi-layer pipe, put onto each other, with one of the material layers here, namely the material layer placed above, constituting a plurality, namely a finite number—here called n—of elements 1*a*, 1*b* . . . 1*n*—preferably plates—placed in circumferential pipe direction. The fact that it may be any number of n elements 1*a*, 1*b*, . . . , 1*n* placed above, is specified in the drawing by a dotted line 11.

The elements placed above 1*a*, 1*b* . . . 1*n* are here placed with their longitudinal edge 4 transversely to the longitudinal edge of the material layer 2 placed below, whereas with their respective transverse edge 4*a* they are here placed parallel to the longitudinal edge of the material layer 2 placed below. Also, the respective first connections $3a_1$, $3a_2$, $3b_1$, $3b_2$, $3n_1$, $3n_2$ provided in this arrangement of the elements 1*a*, 1*b* . . . 1*n* placed onto material layer 2 can be seen here.

Figure 4:
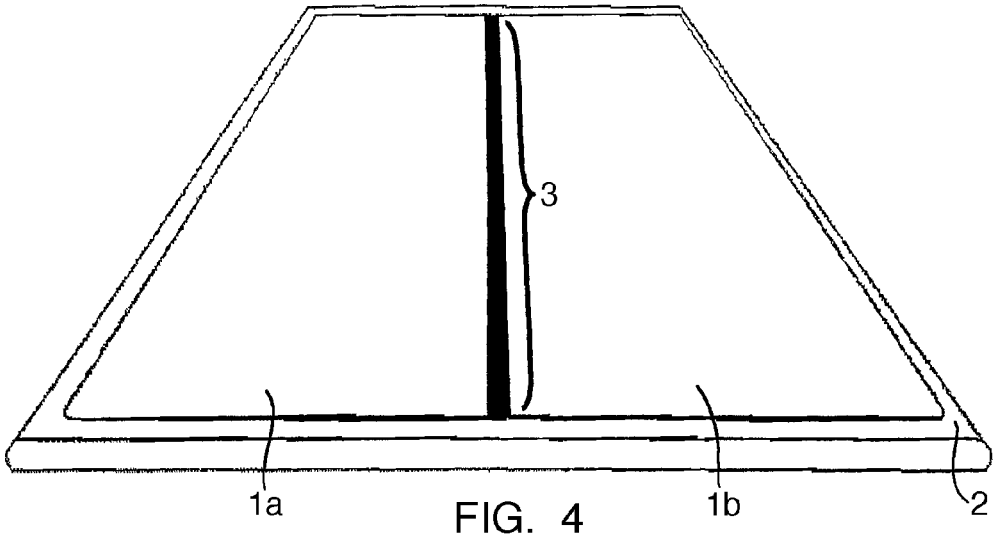
FIG. 4 is a perspective plan view of two material layers, to be combined into a multi-layer pipe, put onto each other, with one of the material layers comprising more than one, namely two elements here—preferably plates—placed above, and a first connection was created here between the material layers by connecting—preferably welding—the elements with the material layer below, after their positioning alongside their joining location, which at the same time constitutes each a longitudinal edge of the elements of the material layer placed above, FIG. 5 a perspective view from a front into a multi-layer pipe according to the present invention during the inventive manufacturing process, namely in the process step where the thus formed multi-layer material is shaped into a pipe by means of the bending roller (not shown here) with a constant friction-tight connection being created between the material layers as a result of the pressure of the rollers from the top and from the bottom, and during shaping, the portions of the material layers, which can still shift freely against each other, shifting freely to each other in accordance with the shaping progress due to the different bend radii of internal pipe and external pipe, FIG. 6 a perspective view from a front into a multi-layer pipe according to the present invention during the inventive manufacturing process, namely in the process step where after a definite shaping progress at least one other connection between the material layers is created by connecting the material layer positioned on top in at least one other position to each other, FIG. 7 a perspective cross-section of a finished multi-layer pipe according to the present invention with internal and external layer, FIG. 8 a perspective cross-section of a multi-layer pipe with internal and external layer with detailed view in the area of the weld seam, FIG. 9 a perspective view of the base plate subsequently constituting the external pipe, with stop edges, and the internal plate subsequently constituting the internal pipe, in the still flat, unworked condition, and FIG. 10 a perspective cross-section of a multi-layer pipe according to the present invention with the base plate of the external plate exhibiting stop edges and the internal plate constituting the internal pipe being clamped in-between these stop edges after the corresponding shaping progress.

FIG. 4 shows a perspective plan view of two material layers 1*a*, 1*b*, 2, to be combined into a multi-layer pipe, put onto each other, with one of the material layers comprising more than one, namely two elements 1*a*, 1*b* here—preferably plates—placed above, and a first connection 3 was created here between the material layers by connecting, preferably welding, the elements 1*a*, 1*b* with the material layer 2 below, after their positioning alongside their joining location, which at the same time constitutes each a longitudinal edge of the elements 1*a*, 1*b* of the material layer placed above. Here, this connection 3 was made alongside the joining location and at the same time longitudinal edge by a closed connection 3, preferably welding, extending over the entire length of the joining location and at the same time longitudinal edge. In particular a connection in sections, preferably, welding, is possible.

Figure 5:
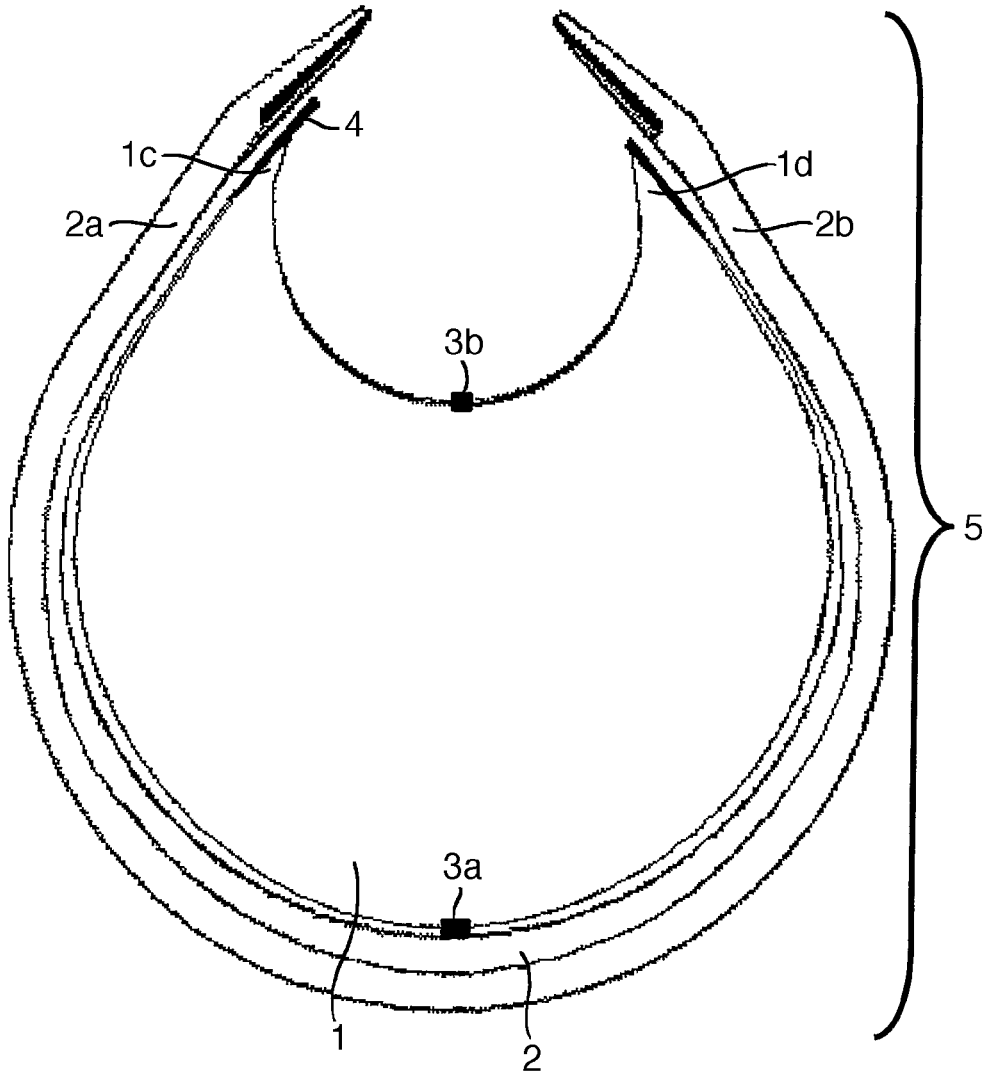

FIG. 5 shows a perspective view from a front into a multi-layer pipe 5 according to the present invention during the inventive manufacturing process, namely in the process step where the thus formed multi-layer material is shaped into pipe 5 by means of the bending roller (not shown here) with a constant friction-tight connection being created between the material layers 1, 2 as a result of the pressure of the rollers from the top and from the bottom, and during shaping, the portions 1*c* against 2*a*, as well as 1*d* against 2*b* of the material layers, which can still shift freely against each other, shifting freely to each other in accordance with the shaping progress due to the different bend radii of internal pipe 1 and external pipe 2. The first connection 3*a*, 3*b* between the two material layers 1, 2 was made here already in two points 3*a*, 3*b* which are located alongside an (imaginary) line parallel to a longitudinal edge of the internal pipe 2, which is forming—namely at the end points there. But in the area of this first connection 3*a* and 3*b* of the material layers 1, 2, these, due to their connection 3*a* and 3*b* with each other, can now no longer shift against each other but remain immobilised or held in position against each other here.

Figure 6:
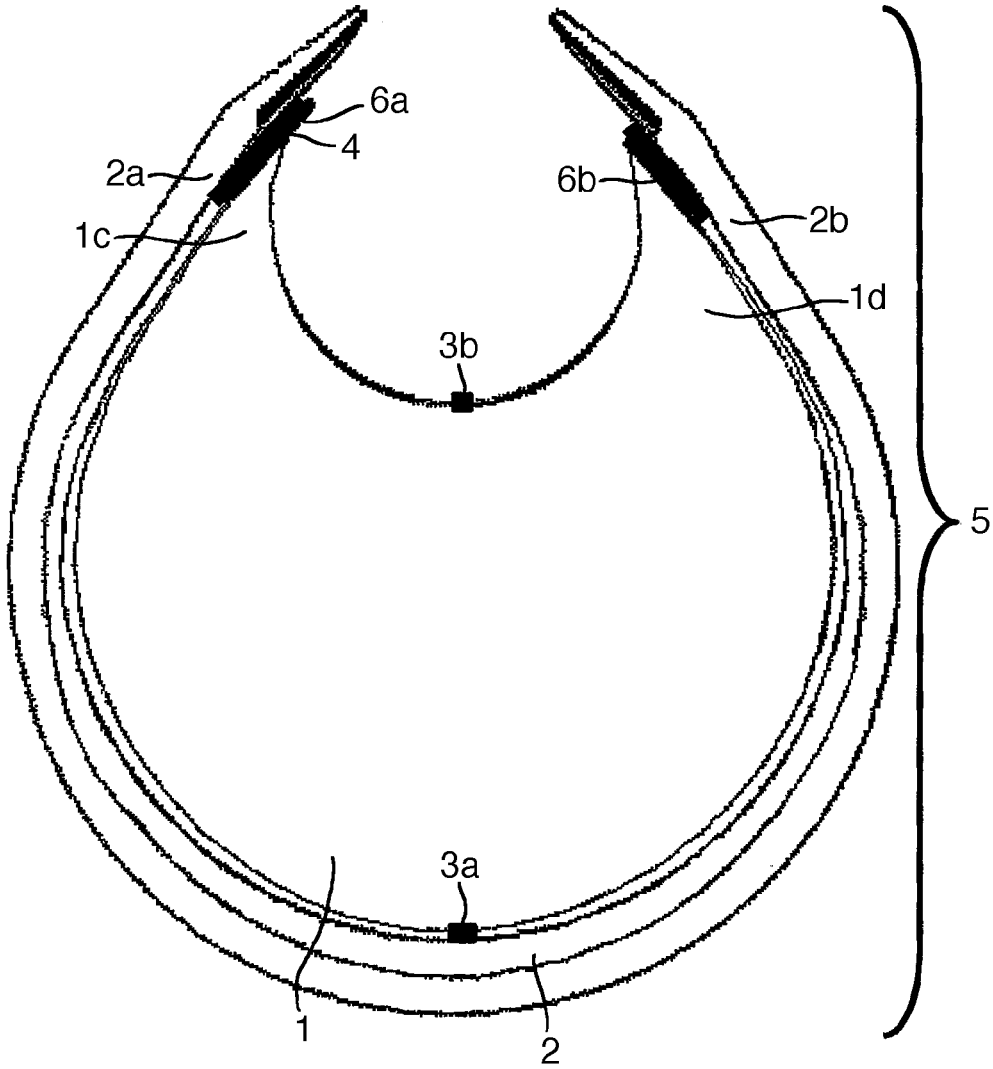

FIG. 6 shows a perspective view from a front into a multi-layer pipe 5 according to the present invention during the inventive manufacturing process, namely in the process step where after a definite shaping progress at least one other connection—two other connections here—6*a* and 6*b*, here formed as a continuous or partial weld seam, between the material layers 1, 2 was created by connecting the material layer 1 positioned on top in at least one other position—in two other positions here—to each other. Subsequently the multi-layer pipe 5 can then be finish-shaped (not shown) by means of the bending roller and/or bending machine, with the material layers shifting no more against each other now during this finish-shaping due to the other connections 6*a* and 6*b*, so that as a result, the material layer 1, 1*c*, 1*d* acting as an internal pipe is pressed non-positively into the material layer 2, 2*a*, 2*b* acting as an external pipe.

Figure 7:
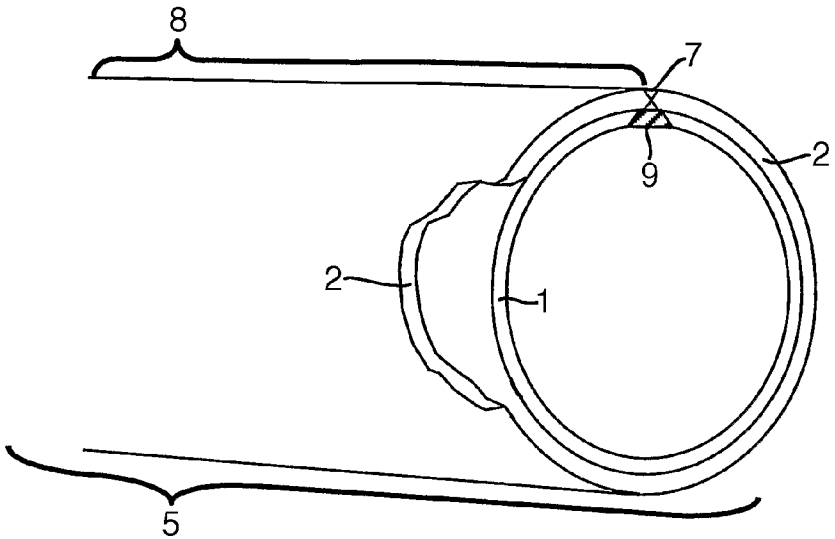

FIG. 7 shows a perspective cross-section of a finished multi-layer pipe according to the present invention with internal layer (also called internal pipe, internal pipeline, internal plate etc.) 1 and external layer (also called external pipe, external pipeline, base plate etc.) 2 with the multi-layer pipe 5 having been closed by means of welding 7 of the external pipe 2 alongside a pipe seam 8 and deposition welding 9 of the internal pipe 1.

Figure 8:
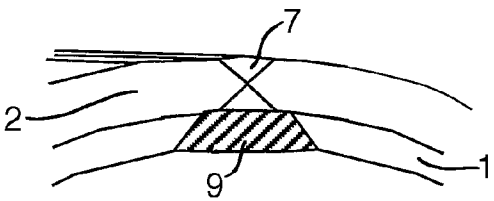

FIG. 8 shows a perspective cross-section of a multi-layer pipe according to FIG. 7 with internal layer 1 and external layer 2 in detailed view in the area of the two weld seams 7, 9.

Figure 9:
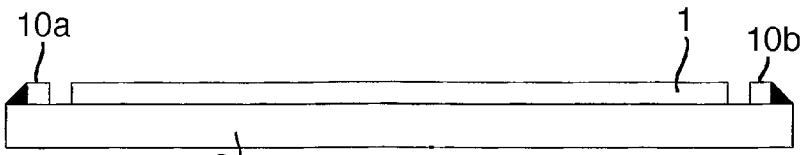

FIG. 9 shows a perspective view of the base plate 2 subsequently constituting the external pipe, with stop edges 10*a*, 10*b*, and the internal plate 1 subsequently constituting the internal pipe, in the still flat, unworked condition. The multi-layer material thus formed is shaped into a multi-layer pipe according to the present invention by means of a bending roller with the material layer 1 acting as an internal pipe being clamped between the stop edges 10*a*, 10*b* and thus being pressed non-positively into the material layer 2 acting as an external pipe. One can also see here that between the edges of the material layer above and the stop edges 10*a*, 10*b*, a gap is left which closes only during the pipe shaping process.

Figure 10:
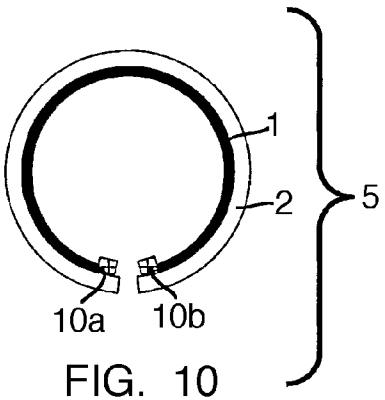

FIG. 10 shows a cross-section of a multi-layer pipe 5 according to the present invention with the base plate of the external plate 2 exhibiting stop edges 10*a*, 10*b* and the internal plate 1 constituting the internal pipe being clamped in-between these stop edges 10*a*, 10*b* after corresponding shaping progress and thus being pressed non-positively into the external pipe 1 as a result of the bending process. The gap between the edges of the material layer above and the stop edges 10*a*, 10*b* has already closed before.

The invention claimed is:

1. A method for manufacturing a multi-layer pipe by means of a bending roller, comprising:

placing individual material layers to be combined into the multi-layer pipe one material layer upon the other material layer, creating a first connection between the material layers in a first position, shaping the material layers into a pipe by means of the bending roller, wherein a constant friction-tight connection is created between the material layers as a result of the pressure of the bending roller, and wherein the material layers shift freely with respect to each other during shaping due to the different bending radii of the one material layer acting as an internal pipe and the other material layer acting as an external pipe, creating at least one other connection between the material layers after a predetermined shaping progress by connecting the material layers to each other in at least one other position, and finish-shaping the multi-layer pipe, such that the material layer acting as an internal pipe is pressed non-positively into the material layer acting as an external pipe.

2. The method according to claim 1, wherein the material layer acting as an internal pipe constitutes a partial circle in cross-section.

3. The method according to claim 1, wherein the first connection between the material layers is created by connecting the material layers to each other along a first edge of the material layer above, and wherein the at least one other connection is created along a second edge of the material layer above.

4. The method according to claim 1, wherein the at least one other connection is created after a shaping progress between greater than 50% and less than 100%.

5. The method according to claim 1, wherein the at least one other connection is created after a shaping progress of approximately $F_{for}$ (indicated in percent), wherein $F_{for}$ (indicated in percent) is calculated as follows:

$$F_{for} = \left(1 - \frac{\frac{\sigma_I}{E} \cdot (DA - 2 \cdot SA - SI) \cdot \pi \cdot (Z_s + 1)}{(DA - SA) \cdot \pi - (DA - 2 \cdot SA - SI) \cdot \pi}\right) \cdot 100$$

with DA being the external diameter of the external pipe in mm,

SA being the wall thickness of the external pipe in mm,

SI being the wall thickness of the internal pipe in mm, $\sigma_I$ being the yield point of the internal pipe in $N/mm^2$, $Z_s$ being the upsetting allowance indicated in percent, and E being the Young's modulus in $N/mm^2$.

6. The method according to claim 1, wherein at least one of the material layers comprises at least two elements positioned above.

7. The method according to claim 6, wherein the elements are placed with their longitudinal edges approximately parallel to the longitudinal edges of the material layer below, and wherein the first connection is created by the elements after their positioning on top of the material layer below.

8. The method according to claim 1, wherein the multi-layer pipe is closed by means of welding of the external pipe alongside the pipe seam and surface welding of the internal pipe.

9. The method according to claim 8, wherein the material layers are connected together after closing at the pipe end faces.

10. The method according to claim 1, wherein a double-layer pipe is manufactured.

11. The method according to claim 1, wherein plates are used as a material layer or as elements of a material layer.

12. The method according to claim 1, wherein at least one of the connections between the material layers is a welding connection.

13. A multi-layer pipe manufactured by a method according to claim 1.

14. A multi-layer pipe according to claim 13, wherein the material layer positioned inside has a higher yield point or proof stress than the outer material layer.

* * * * *